United States Patent [19]

Kwok

[11] 4,215,191

[45] Jul. 29, 1980

[54] LIGHT-SENSITIVE VESICULAR RECORDING MATERIALS AND PROCESS OF USING

[75] Inventor: John C. Kwok, Sarnia, Canada

[73] Assignee: Bexford Limited, London, England

[21] Appl. No.: 9,506

[22] Filed: Feb. 5, 1979

Related U.S. Application Data

[63] Continuation of Ser. No. 810,729, Jun. 28, 1977, abandoned.

[30] Foreign Application Priority Data

Mar. 1, 1977 [GB] United Kingdom ..... 8533/77
May 5, 1977 [GB] United Kingdom ..... 18859/77

[51] Int. Cl.[2] ..... G03C 1/60; G03C 1/76; G03C 5/34

[52] U.S. Cl. ..... 430/152; 430/155; 430/176; 430/192; 430/197; 430/290

[58] Field of Search ..... 96/91 R, 91 N, 75.49, 96/48 HD, 87, 67, 88, 115 R, 35.1, 27 R

[56] References Cited

U.S. PATENT DOCUMENTS

| | | | |
|---|---|---|---|
| 2,791,504 | 5/1957 | Plombeck | 96/86 P |
| 3,032,414 | 5/1962 | James et al. | 96/91 R |
| 3,113,022 | 12/1963 | Cassiers et al. | 96/91 R |
| 3,138,460 | 6/1964 | Levinos | 96/91 R |
| 3,149,971 | 9/1964 | Baril et al. | 96/49 |
| 3,251,690 | 5/1966 | Parker | 96/49 |
| 3,549,376 | 12/1970 | Roos | 96/92 |
| 3,779,774 | 12/1973 | Cope et al. | 96/87 R |
| 3,841,874 | 10/1974 | Nishino | 96/27 R |
| 4,019,909 | 4/1977 | Cohen et al. | 96/115 R |

FOREIGN PATENT DOCUMENTS

| | | |
|---|---|---|
| 2543050 | 9/1976 | Fed. Rep. of Germany . |
| 46-8273 | 3/1971 | Japan . |
| 861250 | 2/1961 | United Kingdom . |
| 1135371 | 12/1968 | United Kingdom . |
| 1272894 | 5/1972 | United Kingdom . |
| 1359086 | 7/1974 | United Kingdom . |

*Primary Examiner*—Charles L. Bowers, Jr.
*Attorney, Agent, or Firm*—Cushman, Darby & Cushman

[57] ABSTRACT

Vesicular recording materials include a sensitized layer which comprises a polymeric vehicle for the sensitizing agent which is a copolymer of 62 to 95 mole % of acrylonitrile or a derivative thereof with acrylamide or a derivative thereof. Preferred copolymers are derived from acrylonitrile and N-tert.butyl acrylamide or diacetone acrylamide. The sensitized layers may contain a surfactant and may be subjected to water treatment.

25 Claims, No Drawings

LIGHT-SENSITIVE VESICULAR RECORDING MATERIALS AND PROCESS OF USING

This is a continuation of application Ser. No. 810,729 filed June 28, 1977, now abandoned.

The present invention relates to photographic recording materials which may be used for veiscular imaging.

Such materials are known in the art and generally comprise a transparent or opaque film or sheet support carrying an imaging layer comprising a plastics vehicle and a sensitizing agent dispersed through the vehicle. The sensitising agent is decomposable on exposure to a light image to evolve a gas such as nitrogen thereby forming a latent gas image in the vehicle. Generally, the latent image may be developed by heating the material, usually above the glass transition temperature of the plastics vehicle, to enable the gas in the light-struck areas to expand into bubbles or vesicles which have a light-scattering or reflecting activity. A typical assembly is described in British Pat. No. 861,250.

Various plastics vehicles have been disclosed in the art for inclusion in the imaging layer. For example, British Pat. No. 861,250 discloses the use of various plastics vehicles such as copolymers derived from acrylonitrile, including copolymers of acrylonitrile with vinyl chloride, styrene, 1,1-difluoroethylene or vinylidene chlorofluoride.

Certain terms employed throughout this specification have the following meaning:

"$D_{max}$" (maximum projection density) relates to the densest image which can be produced in a processed material, the values quoted hereinafter being measured by a Macbeth densitometer TD 528 at an aperture of f4.5 using a Wratten 106 filter.

"$D_{min}$" relates to the lowest density which can be obtained in a processed material, the values quoted hereinafter being measured by a Macbeth densitometer TD 528 at an aperture of f4.5 using a Wratten 106 filter.

"Gamma" represents the rate of change of image density with respect to changes in the logarithm (base 10) of the exposure and is derived from the characteristic curve, i.e. the curve of density/$\log_{10}$ exposure, of the material, as the slope of the straight-line portion of the curve. For low gamma a small change in exposure produces a small change in density whilst for high gamma the same small change in exposure produces a larger change in density.

"Tonal range" relates to the relative ability of the material to reproduce accurately the varying tones in an object, the values quoted hereinafter being assessed as the number of visible image steps upon the material after exposure through a Kodak No. 2 step tablet and development. The first step of the table is transparent and each subsequent step increasingly opaque. The ability of the material to reproduce images of the successive steps is a measure of its tonal range.

"Nitrogen permeability constant" refers to the volume of nitrogen in $cm^3$ which diffuses in one second through one cm of a sample of the polymeric vehicle, one $cm^2$ in area, and under a pressure gradient of one cm of mercury at a constant temperature of 25° C.

"Speed at $D_{min+0.1}$" relates to the speed of the material at a density corresponding to $D_{min}$ determined as described above plus 0.1 of the density at $D_{min}$.

"Thermal Stability" is assessed by measuring $D_{max}$ at ambient temperature and after ageing the material at 95° C. for 5 minutes and relates to the reduction in $D_{max}$ caused by ageing.

According to the present invention a recording material suitable for vesicular imaging comprises a polymeric vehicle and dispersed uniformly therein a sensitising agent which releases a vesicle-forming gas upon exposure to light, said polymeric vehicle comprising a copolymer derived from 62 to 95 mole % of a comonomer having the formula:

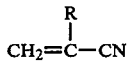

(1)

wherein R represents hydrogen or an alkyl group having from 1 to 5 carbon atoms and another comonomer having the formula:

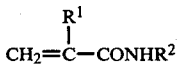

(2)

wherein $R^1$ represents hydrogen or an alkyl group having from 1 to 5 carbon atoms and $R^2$ represents hydrogen, an alkyl group having from 1 to 5 carbon atoms, $—CH_2OH$ or

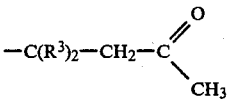

wherein $R^3$ is an alkyl group having from 1 to 5 carbon atoms, said copolymer having a nitrogen permeability constant in the range $1\times10^{-15}$ to $1\times10^{-10}$ and being softenable upon heating above its glass transition temperature to permit the gas released by the sensitising agent in the light-struck areas to form light-scattering or reflecting vesicles therein.

According to another aspect of the invention, a process for the production of a recording material suitable for vesicular imaging comprises producing a polymeric vehicle having dispersed uniformly therein a sensitising agent which releases a vesicle-forming gas upon exposure to light, said polymeric vehicle comprising a copolymer derived from 62 to 95 mole % of a comonomer having the formula:

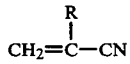

(1)

wherein R represents hydrogen or an alkyl group having from 1 to 5 carbon atoms and another comonomer having the formula:

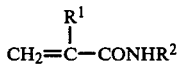

(2)

wherein $R^1$ represents hydrogen or an alkyl group having from 1 to 5 carbon atoms and $R^2$ represents hydrogen, an alkyl group having from 1 to 5 carbon atoms, $—CH_2OH$ or

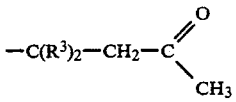

wherein $R^3$ is an alkyl group having from 1 to 5 carbon atoms, said copolymer having a nitrogen permeability constant in the range $1\times10^{-15}$ to $1\times10^{-10}$ and being softenable upon heating above its glass transition temperature to permit the gas released by the sensitising agent in the light-struck areas to form light-scattering or reflecting vesicles therein.

The recording layer comprising the polymeric vehicle and the sensitising agent is preferably applied to a carrier sheet or film. Opaque carriers may be used in recording materials when the image is to be viewed by reflection. In such an assembly, the image vesicles appear white upon reflection of incident light. The opaque carrier is preferably dark in colour to contrast with the image and may comprise a pigmented or coloured plastics film or sheet or paper or card. When the image is to be viewed by light-scattering the carrier is preferably a transparent plastics sheet or film which may consist of any suitable plastics material such as cellulose esters, e.g. cellulose acetate, polystyrene, polyamides, polymers and copolymers of vinyl chloride, polycarbonate, polymers and copolymers of olefines, e.g. polypropylene, polysulphones and linear polyesters which may be obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Biaxially oriented and heat-set films of polyethylene terephthalate are particularly useful as carriers according to this invention.

The copolymeric vehicle included in the recording materials according to the present invention may be derived from one or more other comonomers in addition to the comonomers having the general formulae (1) and (2) above provided the copolymer has a nitrogen permeability constant in the range $1\times10^{-15}$ to $1\times10^{-10}$ and is softenable upon heating above its glass transition temperature to facilitate the formation of light-scattering vesicles. However, the copolymer is preferably derived exclusively from two comonomers of the above general formulae (1) and (2).

The preferred comonomers covered by the general formula (1) comprise acrylonitrile and methacrylonitrile, acrylonitrile being especially preferred.

For comonomers according to formula (2), $R^1$ is preferably hydrogen or methyl and $R^2$ is preferably hydrogen, isopropyl, tert.butyl, —$CH_2OH$ or

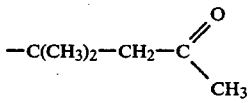

Preferred comonomers according to formula (2) include acrylamide, methacrylamide, N-isopropyl acrylamide, N-tert.butyl acrylamide, N-methylol acrylamide and diacetone acrylamide, the latter having the formula:

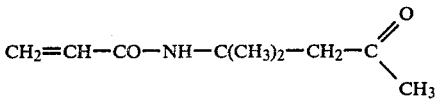

Polymeric vehicles based upon copolymers derived from the preferred comonomers exhibit a beneficial combination of vesiculation properties including properties such as $D_{max}$, gamma, tonal range, speed at $D_{min+0.1}$ and thermal stability.

Copolymers derived from 65 to 90 mole % of the formula (1) comonomer provide effective vesiculation properties, the most beneficial combination of the above properties being obtained with copolymers derived from 75 to 85 mole % of the formula (1) comonomer.

Particularly useful polymeric vehicles comprise copolymers of 75 to 85 mole % acrylonitrile with one formula (2) comonomer chosen from N-tert.butyl acrylamide, diacetone acrylamide, or N-methylol acrylamide.

The copolymer comprising the polymeric vehicle is preferably homogeneous by which is meant that all the copolymer molecules contain substantially the same proportions of the comonomeric constituents. Such homogeneous copolymers may be produced by metering the comonomeric ingredients to the polymerisation medium so as to maintain compositional homogeneity and to achieve the desired copolymer formulation, e.g. as described in U.S. Pat. No. 2,559,155 or British Pat. No. 1,197,721.

A recording layer may be applied to a carrier sheet or film as a solution in any suitable common organic solvent such as acetone or a mixture of acetone with butan-2-one, toluene and/or methanol. However some copolymers especially those of acrylonitrile with acrylamide or methacrylamide are cross-linked and therefore insoluble in organic solvents. Recording layers comprising such copolymers must therefore be applied as aqueous latices.

Surfactants may optionally be included in the polymeric vehicle to improve the vesiculating properties of the vehicle and especially its speed at $D_{min+0.1}$. The optimum amount of surfactant required may be up to 20% by weight based upon the weight of the copolymer. Generally, no more than 10% by weight of the surfactant is required to provide acceptable vesiculation and amounts in the range 0.5 to 5.0% by weight are particularly effective. Such surfactants may be incorporated into the reaction mixture from which the copolymer is derived and may be present in the resulting copolymer as residues from the reaction or alternatively they may be added separately after the copolymerisation reaction. Residual surfactant from the polymerisation reaction may be supplemented by the addition of further surfactant to the polymeric vehicle. Mixtures of surfactants may be employed. Anionic, cationic and non-ionic surfactants are effective according to the invention and may be chosen from the following:

Anionic Surfactants

Fatty alcohol sulphates, e.g. sodium lauryl sulphate; fatty alcohol ether sulphates, e.g. sodium lauryl ether sulphate; alkyl aryl sulphonates, e.g. sodium alkyl benzene sulphonate; alkyl sulphosuccinates, e.g. sodium dioctyl sulphosuccinate; and phosphate esters, e.g. neutralised phosphate esters; and salts of fatty acids, e.g. sodium laurate and ammonium laurate.

Nonionic Surfactants

Polyoxy-2-hydroxy-propylene alkyl phenols, e.g. polyoxy-2-hydroxy propylene (10) alkyl phenol; polyoxyethylene alcohols, e.g. lauryl alcohol ethoxylate; polyoxyethylene esters of fatty acids, e.g. mono-oleate ester of polyethylene glycol; polyoxyethylene alkyl amines, e.g. bis(2-hydroxyethyl)lauryl amine; polyoxyethylene alkyl amides, e.g. oleyl dialkanol (5) amide; polyol surfactants, e.g. sorbitan monolaurate, sorbitan monopalmitate, sorbitan mono-oleate, and polyoxyethylene sorbitan monolaurates; polyalkylene oxide block copolymers, e.g. polyoxyethylene polyoxypropylene glycol; polyoxyethylene alkyl phenols, e.g. polyoxyethylene nonyl phenol derived from 4 moles of ethylene oxide per mole of nonyl phenol; silicone surfactants, e.g. as described in British Pat. No. 1,352,559; and fluorocarbon surfactants, e.g. as described in British Pat. No. 1,352,560.

Cationic Surfactants

Quaternary ammonium compounds.

Plasticisers and additives which reduce the nitrogen permeability of the vehicle may be added to the vehicle if desired.

The sensitising agent incorporated into the vehicle should be non-reactive with the vehicle. Likewise the vesicle-forming gas which is liberated by the sensitising agent should be non-reactive with the vehicle. Sensitising agents which liberate nitrogen on exposure to actinic light, especially ultra-violet light which is widely used in vesicular processing equipment, may be employed according to this invention, suitable agents including nitrogen liberating diazonium salts, such as those which may be derived from the following amines:

N,N-dimethyl-p-phenylenediamine
N,N-diethyl-p-phenylenediamine
N,N-dipropyl-p-phenylenediamine
N-ethyl-N-β-hydroxyethyl-p-phenylenediamine
N,N-dibenzyl-3-ethoxy-4p-phenylenediamine
4-N-morpholino-aniline
2,5-diethoxy-4-N-morpholino-aniline
2,5-dimethoxy-4-N-morpholino-aniline
2,5-di-(n-butoxy)-4-N-morpholino-aniline
4-N-pyrrolidino-aniline
3-methyl-4-N-pyrrolidino-aniline
3-methoxy-4-N-pyrrolidino-aniline
2-ethoxy-4-N,N-diethylamino-aniline
2,5-diethoxy-4-benzoylamino-aniline
2,5-diethoxy-4-thio-(4'-tolyl)-aniline Other suitable sensitising agents include quinonediazides and especially that having the structure:

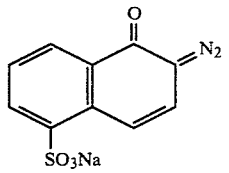

and azide compounds derived from the structure:

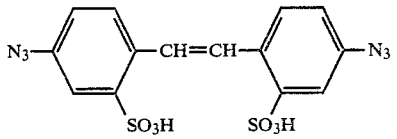

Alternatively, carbazido compounds (carboxylic acid azides) containing a hydroxyl or amino group in the position ortho to the carbazido group may be used.

If desired, a small quantity of a dyestuff and a stabilising acid may be included in the recording layer.

If desired, the surface of the carrier may be pretreated and/or coated with an adhesion-promoting layer prior to the application of the recording layer. The adhesion of the recording layer to a plastics sheet or film carrier may in particular be improved by such a treatment. Polyethylene terephthalate film carriers may be pretreated by coating with solutions of materials having a solvent or swelling action on the film such as halogenated phenols in common organic solvents, e.g. solutions of p-chloro-m-cresol, 2,4-dichlorophenol, 2,4,6- or 2,4,5-trichlorophenol or 4-chlororesorcinol or a mixture of such materials in acetone or methanol. After application of such a solution the film surface can be dried and heated at an elevated temperature for a few minutes, e.g. 2 minutes at 60° to 100° C. If desired, the pretreating solution may also contain an adhesion-promoting polymer such as a partially hydrolysed copolymer of vinyl chloride and vinyl acetate.

As an alternative to, or in addition to, such a pretreatment, a material having a swelling or solvent action upon the film may be incorporated into the coating composition from which the recording layer is applied.

The recording layer may, if desired, be treated with an aqueous solution or steam or water vapour at temperatures of up to 100° C. for up to 300 seconds prior to imagewise exposure in accordance with established practice in the art, e.g. as described in U.S. Pat. No. 3,149,971. Nevertheless, it has been found that surfactants employed as specified above are effective in improving the speed of the recording layer in the absence of any treatment with an aqueous solution or steam or water vapour or when such a treatment is of short duration, e.g. not exceeding 5 seconds. Surfactants do not however increase the speed of the recording layer when such a treatment is more prolonged, e.g. at least 10 seconds.

The resulting recording materials may be exposed to a light image in a conventional manner to produce a latent image in the recording layer. The image may be developed in a conventional manner by heating immediately after light exposure to permit the gas vesicles to form in the light-struck areas. Fixing may then be accomplished by a further overall light exposure and permitting the gas evolved by the decomposition of the sensitising agent to diffuse out of the recording layer. Alternatively, the latent image may be reversal processed by permitting the gas evolved in the imagewise light-struck areas to diffuse out of the recording layer and then subjecting the material to an overall light exposure followed by immediate heating to form gas vesicles in the areas subjected to the overall exposure.

EXAMPLES 1 TO 3

Homogeneous acrylonitrile/N-tert.butyl acrylamide copolymers of varying comonomeric molar proportions were prepared by emulsion polymerisation. The reaction ingredients were as set out in Table 1.

TABLE 1

| Ingredient | Quantities used in each Example | | |
|---|---|---|---|
| | Example 1 | Example 2 | Example 3 |
| Acrylonitrile | 105.4 g<br>85 mole % | 93.8 g<br>80 mole % | 83.7 g<br>75 mole % |
| N-tert.butyl acrylamide | 44.6 g<br>15 mole % | 56.2 g<br>20 mole % | 66.9 g<br>25 mole % |
| Methanol | 30 ml | as Example 1 | as Example 1 |
| Water | 500 ml | | |
| Sodium alkyl benzene sulphonate | 22.5 g | | |
| Ammonium persulphate | 0.45 g | | |
| Sodium metabisulphite | 0.45 g | | |
| 1% weight/volume sulphuric acid | 1.0 ml | | |
| Lauryl mercaptan | 0.9 ml | | |

The polymerisation was carried out in a 1 liter flask fitted with a stirrer, a thermometer, a nitrogen inlet tubing, a water cooled condenser and dropping funnels. The water, sodium alkyl benzene sulphonate, sulphuric acid and lauryl mercaptan were added to the flask, heated to 80° C. and purged with oxygen-free nitrogen gas for 30 minutes. The monomer mixture of acrylonitrile and N-tert.butyl acrylamide in methanol and a solution of the ammonium persulphate and sodium metabisulphate in 60 ml of water as catalyst were added slowly at a rate sufficient to maintain the temperature of the reaction at 80°±2° C. After the addition of the comonomers, the latex was coagulated in twice its volume of methanol. The copolymer was collected, washed with water and vacuum dried.

Coating solutions comprising the resulting copolymers were made up to the following general sensitising composition:

| | | |
|---|---|---|
| acrylonitrile/N-tert.butyl acrylamide copolymer | 10.0 | g |
| 2,5-diethoxy-4-N-morpholino-benzene diazonium fluoroborate | 0.8 | g |
| acetone | 72.0 | g |

The solutions were uniformly coated on one side of 100 micron thick transparent biaxially oriented and heat-set films of polyethylene terephthalate which had been pretreated with a halogenated phenol and were dried at 120° C. for 2.5 minutes to provide a 7 micron thick recording layer.

The dried films were immersed in distilled water at 80° C. for 10 seconds and wiped dry. The films were exposed through a Kodak No. 2 step tablet for 15 seconds to three parallel UV fluorescent lamps in a commercially available vesicular film printer (Canon Kal Printer 480 VC). The exposed films were developed immediately at 130° C. by passing through a commercially available developer (Canon Kal Developer 360 VS).

The applied recording layer exhibited acceptable vesiculation properties as indicated in Table 2.

TABLE 2

| Example | Copolymer mole % acrylontrile/ mole % N-tert.butyl acrylamide | $D_{max}$ | $D_{min}$ | Gamma | Tonal Range number of visible steps |
|---|---|---|---|---|---|
| 1 | 85/15 | 2.40 | 0.09 | 5.4 | 8 |
| 2 | 80/20 | 2.34 | 0.30 | 3.3 | 9 |
| 3 | 75/25 | 2.20 | 0.16 | 3.1 | 8 |

EXAMPLES 4 TO 11

Samples of the recording materials prepared in Examples 1 and 2 were treated for two seconds in a bath of distilled water maintained at 80° C. and wiped dry. The materials were then exposed and developed as described in Examples 1 to 3 and tested for vesiculation properties with the results given in Table 3 (Examples 4 and 7 respectively).

Further recording materials (Examples 5, 6 and 8 to 11) were prepared in accordance with Examples 1 to 3 using the acrylonitrile/N-tert.butyl acrylamide copolymers specified therein and with the addition to the sensitising coating solutions of 5% by weight based on the weight of the copolymer of the surfactants specified in Table 3. The recording materials were treated in distilled water and exposed, developed and tested as specified for Examples 4 and 7, the test results being shown in Table 3.

TABLE 3

| Example | Copolymer mole % acrylonitrile/ mole % N-tert.butyl acrylamide | Surfactant added | $D_{max}$ | $D_{min}$ | Gamma | Tonal Range-number of visible steps | Speed at $D_{min+0.1}$ |
|---|---|---|---|---|---|---|---|
| 4 | 85/15 | None | 2.31 | 0.11 | 5.3 | 6 | 100% |
| 5 | 85/15 | Material commercially available as 'Alcopol' 0 (sodium di-octyl sulphosuccinate) | 2.38 | 0.12 | 3.8 | 7 | 109% |
| 6 | 85/15 | Material commercially available as 'Span' 40 (sorbitan monopalmitate) | 2.36 | 0.15 | 2.9 | 8 | 128% |

TABLE 3-continued

| Example | Copolymer mole % acrylonitrile/ mole % N-tert.butyl acrylamide | Surfactant added | $D_{max}$ | $D_{min}$ | Gamma | Tonal Range-number of visible steps | Speed at $D_{min}+0.1$ |
|---|---|---|---|---|---|---|---|
| 7 | 80/20 | None | 2.05 | 0.11 | 5.2 | 5 | 100% |
| 8 | 80/20 | 'Alcopol' 0 | 2.24 | 0.12 | 3.1 | 9 | 208% |
| 9 | 80/20 | 'Span' 40 | 2.38 | 0.16 | Alcopol'6 | 137% | |
| 10 | 75/25 | 'alcopol'0 | 2.14 | 0.12 | 3.0 | 7 | — |
| 11 | 75/25 | 'Span' 40 | 1.97 | 0.15 | 3.0 | 5 | — |

The materials of Examples 4 to 11 exhibited satisfactory vesicular properties. The increase in the speed of the recording layer resulting from the presence of the surfactant was greater for the copolymers comprising lower amounts of acrylonitrile (80 mole %) than for copolymers comprising 85 mole %. 'Alcopol' O also improved the tonal range of the recording material.

EXAMPLES 12 TO 14

Using the 80/20 mole % acrylonitrile/N-tert.butyl acrylamide copolymer of Example 2, recording materials were prepared as described in relation to Examples 1 to 3. In Examples 13 and 14, 2% by weight based on the weight of the copolymer of the surfactants specified in Table 4 were added to the sensitising coating solutions. The recording materials were treated in distilled water and exposed, developed and tested as specified for Examples 4 to 11, the test results being shown in Table 4.

TABLE 4

| Example | Surfactant added | $D_{max}$ | $D_{min}$ | Gamma | Tonal Range-number of visible steps | Speed at $D_{min}+0.1$ |
|---|---|---|---|---|---|---|
| 12 | None | 1.60 | 0.10 | 2.5 | 4 | 100% |
| 13 | Material commercially available as 'Nansa' 1106 (sodium alkyl benzene sulphonate) | 2.23 | 0.09 | 3.0 | 7 | 225% |
| 14 | sodium lauryl sulphate | 2.20 | 0.10 | 3.2 | 8 | 245% |

The resulting recording materials exhibited satisfactory vesiculating properties.

EXAMPLES 15 TO 22

Examples 12 to 14 were repeated, with the exception that no surfactant was added to the sensitising coating solutions of Examples 15 and 19, and with the addition of the surfactants in the amounts indicated in Table 5 to the other coating solutions and with the treatment in distilled water prolonged to four seconds. The vesiculating properties of the materials are shown in Table 5.

TABLE 5

| Example | Surfactant added | Amount of surfactant % by weight based on weight of copolymer | $D_{max}$ | $D_{min}$ | Gamma | Tonal Range-number of visible steps | Speed at $D_{min}+0.1$ |
|---|---|---|---|---|---|---|---|
| 15 | None | None | 2.12 | 0.14 | 4.0 | 6 | 100% |
| 16 | Material commercially available as 'Nansa' 1106 (sodium alkyl benzene sulphonate) | 2% | 2.22 | 0.13 | 2.8 | 8 | 150% |
| 17 | Sodium lauryl sulphate | 2% | 2.27 | .19 | 2.6 | 10 | 158% |
| 18 | Material commericially available as 'Ethomid' 0/15 (oleyl dialkanol (5) amide) | 2% | 2.20 | 0.07 | 3.4 | 7 | 125% |
| 19 | None | None | 1.70 | 0.10 | 2.8 | 6 | 100% |
| 20 | Material commercially available as 'Antarox' C0430 (polyoxyethylene (4) nonyl phenol) | 2% | 1.75 | 0.08 | 2.8 | 6 | 109% |
| 21 | Material commercially available as 'Empilan' BQ100 (mono-oleate ester of polyethylene glycol) | 2% | 1.94 | 0.11 | 2.3 | 7 | 107% |
| 22 | Material commercially available as 'Tween' 20 (polyoxyethylene (20) | 2% | 2.04 | 0.09 | 3.2 | 7 | 123% |

TABLE 5-continued

| Example | Surfactant added | Amount of surfactant % by weight based on weight of copolymer | $D_{max}$ | $D_{min}$ | Gamma | Tonal Range-number of visible steps | Speed at $D_{min}$ +0.1 |
|---|---|---|---|---|---|---|---|
| | sorbitan monolaurate) | | | | | | |

The recording materials of these examples exhibited satisfactory vesiculating properties.

EXAMPLES 23 TO 32

Homogeneous 85/15 mole % (Examples 23 to 31) and 80/20 mole % (Example 32) acrylonitrile/diacetone acrylamide copolymers were prepared by the procedure described in Examples 1 to 3 using 96 g of acrylonitrile and 54 g of diacetone acrylamide, and 83.5 g of acrylonitrile and 66.5 g of diacetone acrylamide respectively in place of the corresponding ingredients in the reaction mixture of Examples 1 to 3.

Recording materials were prepared in accordance with Examples 1 to 3 using these acrylonitrile/diacetone acrylamide copolymers in place of the copolymers specified in the sensitising coating solutions of Examples 1 to 3 and with the addition of surfactants in the amounts shown in Table 6 to some of the solutions. Some of the recording materials were treated in a bath of distilled water maintained at 80° C. for the periods indicated in Table 6.

All of the recording materials tested in Table 6 exhibited satisfactory vesiculation properties. The greater improvement in speed attributable to the presence of a surfactant was obtained with shorter or no water treatment. The best improvement in speed was obtained in the absence of a water treatment.

EXAMPLES 33 TO 35 AND COMPARATIVE EXAMPLES A AND B

Recording materials were prepared in accordance with Examples 1 to 3 using in the coating solutions copolymers comprising 80/20 mole % and 75/25 mole % acrylonitrile/N-tert.butyl acrylamide and 85/15 mole % acrylonitrile/diacetone acrylamide in Examples 33 to 35 respectively and copolymers comprising 76.8/23.2 weight % acrylonitrile/vinyl acetate and 75.3/24.7 weight % acrylonitrile/methyl acrylate in Comparative Examples A and B respectively. The materials were exposed to light through a step tablet and developed as described in Examples 1 to 3 and $D_{max}$ was measured for each step at ambient temperature and again after ageing at 95° C. for five minutes. The results are shown in Table 7.

TABLE 6

| Example | Surfactant added | Amount of surfactant % by weight based on weight of copolymer | Duration of water treatment - seconds | $D_{max}$ | $D_{min}$ | Gamma | Tonal Range-number of visible steps | Speed at $D_{min}$ +0.1 |
|---|---|---|---|---|---|---|---|---|
| 23 | None | None | 10 | 12.32 | 0.18 | 3.7 | 11 | 100% |
| 24 | Material commercially available as 'Span' 40 (sorbitan monopalmitate) | 5% | 10 | 2.38 | 0.20 | 34 | 11 | 100% |
| 25 | Sodium lauryl sulphate | 2% | 10 | 2.43 | 0.14 | 4.0 | 12 | 100% |
| 26 | None | None | 2 | 1.60 | 0.12 | 1.9 | 5 | 100% |
| 27 | 'Span' 40 | 5% | 2 | 2.30 | 0.18 | 4.2 | 7 | 127% |
| 28 | Sodium lauryl sulphate | 2% | 2 | 2.40 | 0.12 | 3.8 | 9 | 165% |
| 29 | None | None | None | 1.10 | 0.11 | 3.3 | 2 | 100% |
| 30 | 'Span' 40 | 5% | None | 2.34 | 0.17 | 5.6 | 7 | 272% |
| 31 | Sodium lauryl sulphate | 2% | None | 2.24 | 0.12 | 8.7 | 3 | 156% |
| 32 | None | None | 2 | 2.30 | 0.12 | 3.4 | 6 | — |

TABLE 7

| | Example ageing | | Example 34 | | Example 35 | | Comparative Example A | | Comparative Example B | |
|---|---|---|---|---|---|---|---|---|---|---|
| | 62.6/37.4 weight % (80/20 mole %) acrylonitrile/ N-tert.butyl acrylamide copolymer $D_{max}$ | | 55.8/44.2 weight % (75/25 mole %) acrylonitrile/ N-tert.butyl acrylamide copolymer $D_{max}$ | | 64.0/36.0 weight % (85/15 mole %) acrylonitrile/ diacetone acrylamide copolymer $D_{max}$ | | 76.8/23.2 weight % (84.3/15.7 mole%) acrylonitrile/ vinyl acetate copolymer $D_{max}$ | | 75.3/24.7 weight % (83.2/16.8 mole %) acrylonitrile/ methyl acrylate copolymer $D_{max}$ | |
| Step No. | Before ageing | After ageing at 95° C. for 5 minutes | Before ageing | After ageing at 95° C. for 5 minutes | Before ageing | After ageing at 95° C. for 5 minutes | Before ageing | After ageing at 95° C. for 5 minutes | Before ageing | After ageing at 95° C. for 5 minutes |
| 1 | 2.16 | 2.16 | 2.16 | 2.16 | 2.32 | 2.16 | 2.44 | 2.36 | 2.30 | 0.76 |
| 2 | 2.14 | 2.14 | 2.16 | 2.15 | 2.32 | 2.20 | 2.44 | 2.36 | 2.20 | 0.48 |
| 3 | 2.22 | 2.22 | 2.11 | 2.10 | 2.30 | 2.16 | 2.42 | 2.36 | 1.62 | 0.30 |
| 4 | 2.16 | 2.16 | 1.48 | 1.45 | 2.30 | 2.06 | 2.34 | 2.26 | 0.87 | 0.17 |
| 5 | 2.07 | 2.06 | 0.71 | 0.71 | 2.21 | 1.58 | 2.28 | 1.75 | 0.41 | 0.12 |
| 6 | 1.57 | 1.52 | 0.36 | 0.33 | 1.84 | 1.06 | 1.96 | 0.98 | 0.23 | 0.10 |

TABLE 7-continued

| Step No. | Example ageing: 62.6/37.4 weight % (80/20 mole %) acrylonitrile/ N-tert.butyl acrylamide copolymer $D_{max}$ Before ageing | After ageing at 95° C. for 5 minutes | Example 34: 55.8/44.2 weight % (75/25 mole %) acrylonitrile/ N-tert.butyl acrylamide copolymer $D_{max}$ Before ageing | After ageing at 95° C. for 5 minutes | Example 35: 64.0/36.0 weight % (85/15 mole %) acrylonitrile/ diacetone acrylamide copolymer $D_{max}$ Before ageing | After ageing at 95° C. for 5 minutes | Comparative Example A: 76.8/23.2 weight % (84.3/15.7 mole%) acrylonitrile/ vinyl acetate copolymer $D_{max}$ Before ageing | After ageing at 95° C. for 5 minutes | Comparative Example B: 75.3/24.7 weight % (83.2/16.8 mole %) acrylonitrile/ methyl acrylate copolymer $D_{max}$ Before ageing | After ageing at 95° C. for 5 minutes |
|---|---|---|---|---|---|---|---|---|---|---|
| 7 | 0.85 | 0.85 | 0.18 | 0.18 | 1.19 | 0.68 | 1.55 | 0.63 | 0.14 | 0.10 |
| 8 | 0.22 | 0.22 | 0.12 | 0.12 | 0.76 | 0.43 | 1.08 | 0.34 | 0.10 | — |
| 9 | — | — | — | — | 0.48 | 0.36 | 0.60 | 0.19 | — | — |
| 10 | — | — | — | — | 0.33 | 0.27 | 0.40 | 0.18 | — | — |

The polymeric vehicles of Examples 33 to 35 exhibited good retention of density and better resistance to ageing than those of the comparative examples.

I claim:

1. A recording material suitable for vesicular imaging which comprises a polymeric vehicle and dispersed uniformly therein a sensitising agent which releases a vesicle-forming nitrogen gas upon exposure to light, said polymeric vehicle comprising a copolymer derived from 62 to 95 mole % of a comonomer having the formula:

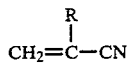

(1)

wherein R represents hydrogen or an alkyl group having from 1 to 5 carbon atoms, and another comonomer having the formula:

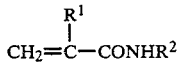

(2)

wherein $R^1$ represents hydrogen or an alkyl group having from 1 to 5 carbon atoms and $R^2$ represents hydrogen, an alkyl group having from 1 to 5 carbon atoms, $—CH_2OH$ or

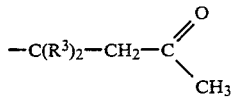

wherein $R^3$ is an alkyl group having from 1 to 5 carbon atoms, said copolymer having a nitrogen permeability constant in the range $1\times10^{-15}$ to $1\times10^{-10}$ and being softenable upon heating above its glass transition temperature to permit the gas released by the sensitising agent in the light-struck areas to form light-scattering or reflecting vesicles therein said recording material being in the form of a recording layer applied to a carrier sheet or film.

2. A recording material according to claim 1, in which the carrier sheet or film comprises a biaxially oriented and heat-set film of polyethylene terephthalate.

3. A recording material according to claim 1, in which the comonomer having the formula (1) comprises acrylonitrile or methacrylonitrile and wherein said polymeric vehicle consists essentially of a copolymer derived from 62 to 95 mole percent of a comonomer having the formula (1) and 5 to 38 mole percent of a comonomer having the formula (2).

4. A recording material according to claim 1, in which in the comonomer according to formula (2), $R^1$ is hydrogen or methyl and $R^2$ is hydrogen, isopropyl, tert.butyl, $—CH_2OH$ or

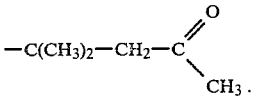

5. A recording material according to claim 4, in which the comonomer having the formula (2) comprises acrylamide, methacrylamide, N-isopropyl acrylamide, N-tert.butyl acrylamide, N-methylol acrylamide or diacetone acrylamide.

6. A recording material according to claim 1, in which the copolymer included in the polymeric vehicle is derived from 65 to 90 mole % of the comonomer having the formula (1).

7. A recording material according to claim 6, in which the copolymer included in the polymeric vehicle is derived from 75 to 85 mole % of the comonomer having the formula (1).

8. A recording material according to claim 1, in which the copolymer included in the polymeric vehicle comprises a copolymer of 75 to 85 mole % acrylonitrile with a formula (2) comonomer selected from the group consisting of N-tert.butyl acrylamide, diacetone acrylamide, and N-methylol acrylamide.

9. A recording material according to claim 1, in which the polymeric vehicle includes a surfactant.

10. A recording material according to claim 9, in which the surfactant comprises no more than 10% by weight based upon the weight of the copolymer in the polymeric vehicle.

11. A recording material according to claim 1, which has been treated with an aqueous solution or steam or water vapour at a temperature of up to 100° C. and for a time up to 300 seconds.

12. A recording material according to claim 3, in which the sensitising agent comprises a nitrogen-liberating diazonium salt, the comonomer having the formula (1) is acrylonitrile and the comonomer having the formula (2) is N-tertiary butyl acrylamide or diacetone acrylamide.

13. A process for the production of a recording material suitable for vesicular imaging which comprises producing a polymeric vehicle having dispersed uniformly therein a sensitising agent which releases a vesicle-forming nitrogen gas upon exposure to light, said polymeric vehicle comprising a copolymer derived from 62 to 95 mole % of a comonomer having the formula:

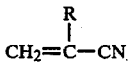

(1)

wherein R represents hydrogen or an alkyl group having from 1 to 5 carbon atoms and another comonomer having the formula:

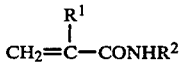

(2)

wherein $R^1$ represents hydrogen or an alkyl group having from 1 to 5 carbon atoms and $R^2$ represents hydrogen, an alkyl group having from 1 to 5 carbon atoms, $—CH_2OH$ or

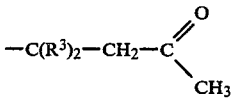

wherein $R^3$ is an alkyl group having from 1 to 5 carbon atoms, said copolymer having a nitrogen permeability constant in the range $1\times10^{-15}$ to $1\times10^{-10}$ and being softenable upon heating above its glass transition temperature to permit the gas released by the sensitising agent in the light-struck areas to form light-scattering or reflecting vesicles therein, and applying a recording layer comprising the polymeric vehicle and the sensitising agent to a carrier sheet or film.

14. A process according to claim 13, in which the carrier sheet or film comprises a biaxially oriented and heat-set film of polyethylene terephthalate.

15. A process according to claim 13, in which the comonomer having the formula (1) comprises acrylonitrile or methacrylonitrile.

16. A process according to claim 13, in which in the comonomer according to formula (2), $R^1$ is hydrogen or methyl and $R^2$ is hydrogen, isopropyl, tert.butyl, $—CH_2OH$ or

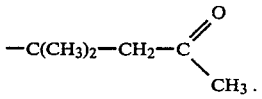

17. A process according to claim 16, in which the comonomer having the formula (2) comprises acrylamide, methacrylamide, N-isopropyl acrylamide, N-tert-.butyl acrylamide, N-methylol acrylamide or diacetone acrylamide.

18. A process according to claim 13, in which the copolymer included in the polymeric vehicle is derived from 65 to 90 mole % of the comonomer having the formula (1).

19. A process according to claim 18, in which the copolymer included in the polymeric vehicle is derived from 75 to 85 mole % of the comonomer having the formula (1).

20. A process according to claim 13, in which the copolymer included in the polymeric vehicle comprises a copolymer of 75 to 85 mole % acrylonitrile with a formula (2) comonomer selected from the group consisting of N-tert.butyl acrylamide, diacetone acrylamide, and N-methylol acrylamide.

21. A process according to claim 13, in which the polymeric vehicle includes a surfactant.

22. A process according to claim 21, in which the surfactant comprises no more than 10% by weight based upon the weight of the copolymer in the polymeric vehicle.

23. A process according to claim 13, in which the polymeric vehicle is treated with an aqueous solution or steam or water vapour at a temperature of up to 100° C. and for a time up to 300 seconds.

24. A process according to claim 13, in which the recording layer is applied to the carrier sheet or film as a solution in an organic solvent.

25. A process according to claim 13, in which the sensitising agent comprises a nitrogen-liberating diazonium salt.

* * * * *